US012478167B1

(12) United States Patent
Zhang et al.

(10) Patent No.: US 12,478,167 B1
(45) Date of Patent: Nov. 25, 2025

(54) SUSPENSION MODULE AND BACKPACK WITH SHOCK ABSORBING EFFECT

(71) Applicant: SHENZHEN HYPOTH-INNOVATE TECHNOLOGY CO., LTD, Guangdong (CN)

(72) Inventors: Jinyu Zhang, Guangdong (CN); Xiangyin Cao, Guangdong (CN)

(73) Assignee: SHENZHEN HYPOTH-INNOVATE TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 19/001,268

(22) Filed: Dec. 24, 2024

Related U.S. Application Data

(63) Continuation of application No. PCT/CN2023/131977, filed on Nov. 16, 2023.

(30) Foreign Application Priority Data

Oct. 12, 2022 (CN) ..... 202222689076.2
Feb. 15, 2023 (CN) ..... 202320286612.6

(51) Int. Cl.
*A45F 3/04* (2006.01)

(52) U.S. Cl.
CPC ..... *A45F 3/04* (2013.01)

(58) Field of Classification Search
CPC ..... A45F 3/04; F16F 3/02; F16F 3/04
USPC ..... 267/140.2
See application file for complete search history.

(56) References Cited

U.S. PATENT DOCUMENTS 5,411,194 A * 5/1995 Nagasawa ..... A45C 13/26 224/257
5,915,608 A * 6/1999 Mao ..... A45F 5/02 224/616
6,619,523 B1 * 9/2003 Duckworth ..... A47D 13/025 224/641
8,240,531 B2 * 8/2012 Lam ..... A45F 3/04 224/644
9,192,221 B2 * 11/2015 Just ..... A45F 3/047
10,849,410 B2 * 12/2020 Ng ..... A45C 13/001
2019/0254409 A1 * 8/2019 Kim ..... A45F 3/14
2024/0130510 A1 * 4/2024 Zhao ..... A45F 3/12

FOREIGN PATENT DOCUMENTS

CN 108887863 A * 11/2018 ..... A45F 3/10
CN 212650566 U * 3/2021
CN 216494019 U * 5/2022
CN 117397925 A * 1/2024 ..... A45F 3/04
TW 202011865 A * 4/2020 ..... A45C 13/001

* cited by examiner

*Primary Examiner* — Scott T Mcnurlen
(74) *Attorney, Agent, or Firm* — PV IP PC; Wei Te Chung

(57) ABSTRACT

A suspension module and backpack with a shock absorbing effect, including: a housing, having an opening at an upper side thereof and defining one or more guide recesses; a puller, extending through the opening and slidably connected to the one or more guide recesses, wherein the puller defines a cavity, in which a movable rod is provided, one end of the movable rod extends through the cavity and is movable up and down, and a pin is provided on the movable rod to limit a movable distance of the movable rod; a first elastic component, having an upper end connected to the puller and a lower end connected to the housing; and a second elastic component, having an upper end connected to the movable rod and a lower end connected to the housing.

20 Claims, 9 Drawing Sheets

SUSPENSION MODULE AND BACKPACK WITH SHOCK ABSORBING EFFECT

CROSS REFERENCE TO RELATED APPLICATIONS

This application is a continuation of International Application No. PCT/CN2023/131977, filed on Nov. 16, 2023, which claims priority to Chinese Patent Application No. 202222689076.2, filed on Oct. 12, 2022, and entitled "Suspension Module and Backpack with Shock Absorbing Effect", and claims priorities to Chinese Patent Application No. 202320286612.6, filed on Feb. 15, 2023, and entitled "Suspension Module and Backpack with Shock Absorbing Effect". The entire disclosures of the above applications are incorporated herein by reference.

TECHNICAL FIELD

The present application relates to the technical field of shock absorber, and more specifically, to a suspension module and backpack with a shock absorbing effect.

BACKGROUND

Backpacks are common items in people's daily lives. When walking, the backpack will shake up and down with the body, and the sinking impact force generated can be as much as 3 times the weight of the backpack itself. During long-term walking movements, it will continue to repeatedly cause greater pressure on the shoulders and neck. In order to alleviate the impact force generated by the backpack during walking and reduce the pressure of the backpack on the shoulders and neck, there are currently three types of backpacks on the market. The first type relies on the shoulder strap elastomer to generate buffering, the second type uses an external mechanical slide rail structure, and the third type uses a built-in one-way spring structure. However, the first type using elastomeric shoulder strap cannot bear high load buffering, and the elastic expansion rate of the elastomer is low, the buffering effect is limited, and the service life is also limited; the second type using external mechanical slide rail structure itself is complex in structure, expensive, and occupies a large space; the third type using built-in one-way spring structure is relatively the best solution, but the springs used in this type of structure, whether one or two, whether tension springs or compression springs, are effective throughout the entire carrying process, and the full-time effect causes the spring to only work within its own effective expansion and contraction range. Therefore, the biggest problem with this type of solution is that the buffer load threshold is small, and it can only have a good suspension buffering effect at 4-6 kg, and it does not work when the load is too low, such as a children's bag, or too high, such as an outdoor backpack, a photography equipment backpack, etc.

SUMMARY

The technical problem to be solved by the present application is that, in view of the above-mentioned defects of the prior art, a suspension module and a backpack with a shock absorbing effect are proposed.

The technical solution adopted by the application to solve the technical problems thereof is to propose a suspension module with a shock absorbing effect, including:

a housing, having an opening at an upper side thereof and defining one or more guide recesses;

a puller, extending through the opening and slidably connected to the one or more guide recesses, wherein the puller defines a cavity, in which a movable rod is provided, one end of the movable rod extends through the cavity and is movable up and down, and a pin is provided on the movable rod to limit a movable distance of the movable rod;

a first elastic component, having an upper end connected to the puller and a lower end connected to the housing; and a second elastic component, having an upper end connected to the movable rod and a lower end connected to the housing.

In some embodiments, the first elastic component and the second elastic component are tension springs, and the first elastic component includes two of the tension springs, and the second elastic component includes one of the tension springs.

In some embodiments, the housing includes a front housing and a rear housing; wherein the rear housing defines a plurality of positioning holes;

a plurality of positioning pins are provided on an inner side of the front housing, and are configured to be plugged into the positioning holes.

In some embodiments, the puller includes a connecting part, a hook and guide posts;

wherein the hook is arranged below the connecting part, and the hook is configured to connect with the upper end of the first elastic component;

the guide posts are arranged on both sides of the connecting part, and the guide posts are connected to the one or more guide recesses; and the connecting part, the hook and the guide posts are integrally formed.

In some embodiments, a limiting block is provided at an end of each of the guide posts away from the connecting part, and a limit surface is provided at an upper side of each of the one or more guide recesses to stop the limiting block of the guide post connected to the guide recess when the limiting block moves to the upper side of the guide recess.

In some embodiments, each of the one or more guide recesses includes a slide slot and an arc slot;

wherein the slide slot is arranged on an inner side of the rear housing and is slidably connected to a corresponding one of the guide posts;

the arc slot is arranged on the inner side of the front housing and is arranged outside the guide post, so that the guide post is movable along a fixed direction.

In some embodiments, at least one of the plurality of positioning pins defines a hanging groove configured to fix the lower end of the first elastic component and the lower end of the second elastic component.

In some embodiments, the housing defines an avoidance groove to reduce friction and noise generated when the first elastic component and the second elastic component are stretched.

In some embodiments, the front housing is provided with a mark to show a value of load weight of the suspension module in real time.

In some embodiments, the front housing is partially or fully transparent for displaying a real-time position of the guide posts.

In some embodiments, it further includes stitching holes provided around the rear housing, so that the suspension module with a shock absorbing effect is embedded and connected to a backpack body.

In some embodiments, the front housing is made of hard plastic, and the rear housing is made of soft plastic.

The present application also provides a backpack, including the above suspension module with a shock absorbing effect.

The suspension module with a shock absorbing effect can achieve a shock absorbing effect under different load conditions based on the first elastic component and the second elastic component, has a large load threshold range, occupies a small space, and has a wide range of applications.

BRIEF DESCRIPTION OF THE DRAWINGS

The present application will be further described below in conjunction with the accompanying drawings and embodiments, in which.

Figure 1:
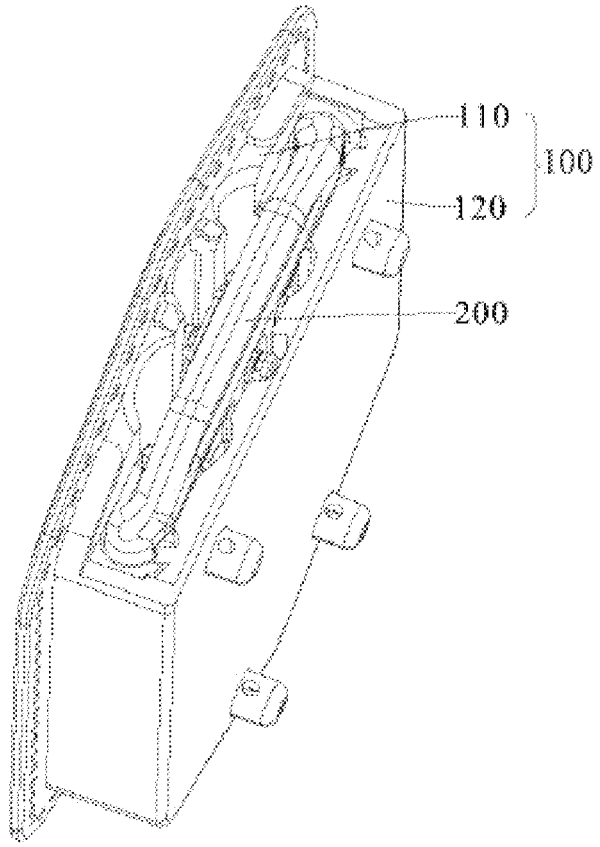
FIG. 1 is a top view of a suspension module with a shock absorbing effect according to the present application.
Figure 2:
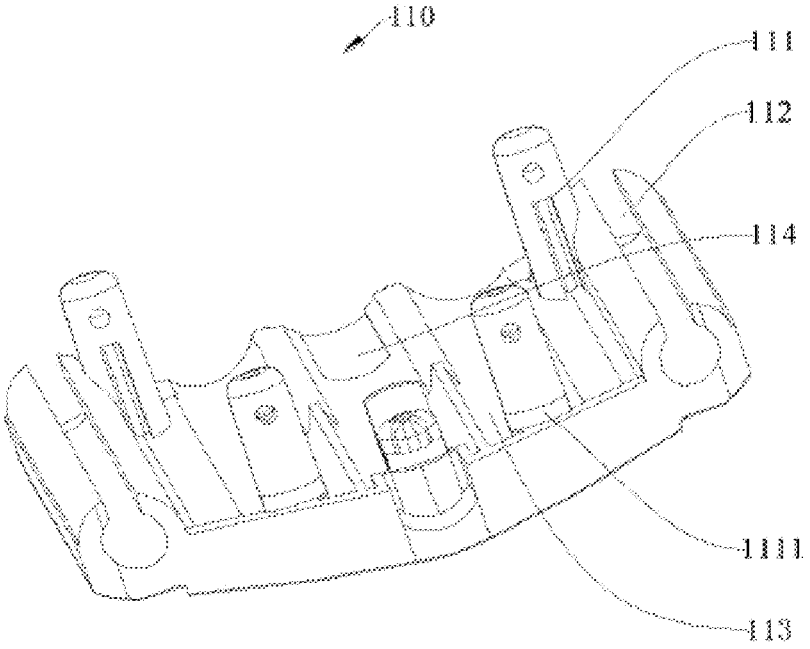
FIG. 2 is a schematic diagram showing the three-dimensional structure of the front housing of the suspension module with a shock absorbing effect shown in FIG. 1.
Figure 3:
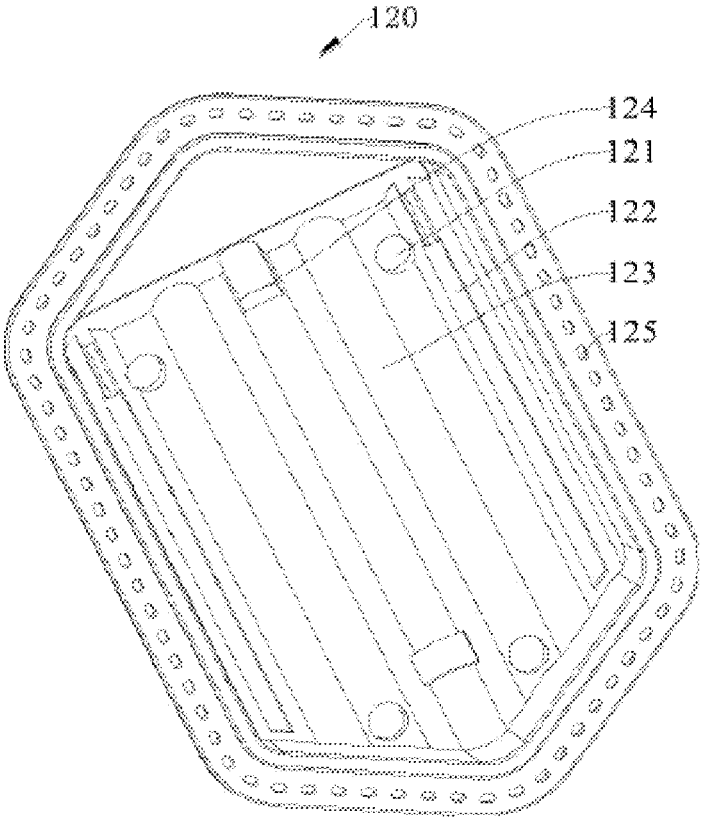
FIG. 3 is a schematic diagram showing the three-dimensional structure of the rear housing of the suspension module with a shock absorbing effect shown in FIG. 1.

List of the reference numerals:

housing 100, front housing 110, positioning pin 111, hanging groove 1111, arc slot 112, first groove 113, first limiting groove 114, mark 115, rear housing 120, positioning hole 121, slide slot 122, second groove 123, guide recess 130, limiting surface 131, second limiting groove 124, stitching hole 125, avoidance groove 140;

puller 200, connecting part 210, hook 220, guide post 230, limiting block 231, movable slot 240, movable rod 250, connecting hole 251, pin 252;

elastic component 300, first elastic component 310, second elastic component 320.

DETAILED DESCRIPTION OF THE EMBODIMENTS

The technical solutions in the embodiments of the application will be clearly and completely described below in conjunction with the drawings in the embodiments of the application. Obviously, the described embodiments are only part of the embodiments of the application, not all of them. Based on the embodiments of the present application, all other embodiments obtained by those skilled in this field without creative work are within the scope of protection of the present application.

In order to solve the problem of low load threshold of existing shock absorbing backpacks, the present application provides a suspension module with shock absorbing effect, which has a large threshold range, occupies a small space, and has a wide range of applications.

As shown in FIGS. 1 to 7, the suspension module includes: a housing 100, a puller 200, a first elastic component 310 and a second elastic component 320. The housing 100 has an opening at an upper side thereof and defines two guide recesses 130. The puller 200 extends through the opening and is slidably connected to the guide recesses 130. The puller 200 can move up and down along the guide recesses 130. The puller 200 has a cavity, on which a movable slot 240 is defined. A movable rod 250 is provided in the cavity. An end of the movable rod 250 extends through the cavity and can move up and down. A pin 252 is provided on the movable rod 250 to allow the movable rod 250 to move within the range of the movable slot 240. The upper end of the first elastic component 310 is connected to the puller 200, and the lower end is connected to the housing 100; the upper end of the second elastic component 320 is connected to the movable rod 250, and the lower end is connected to the housing 100.

Figure 4:
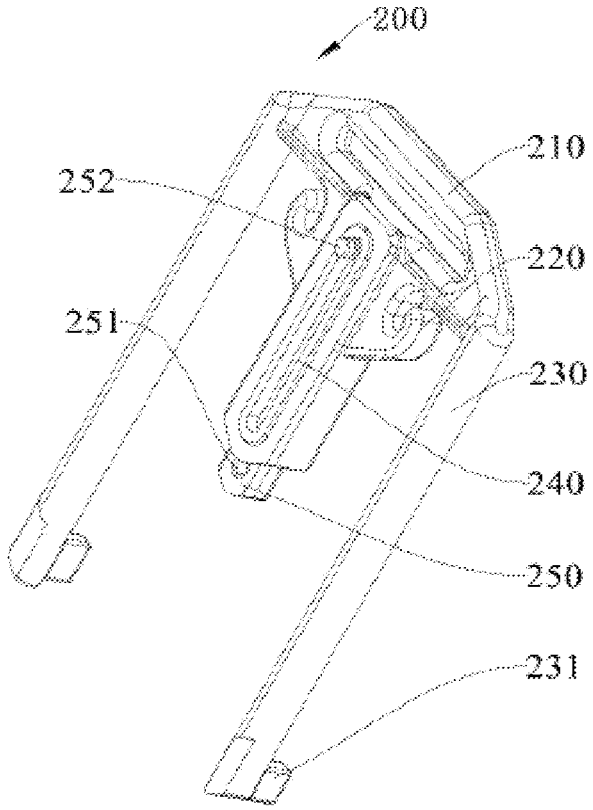
FIG. 4 is a schematic diagram showing the three-dimensional structure of the puller of the suspension module with a shock absorbing effect shown in FIG. 1.
Figure 5:
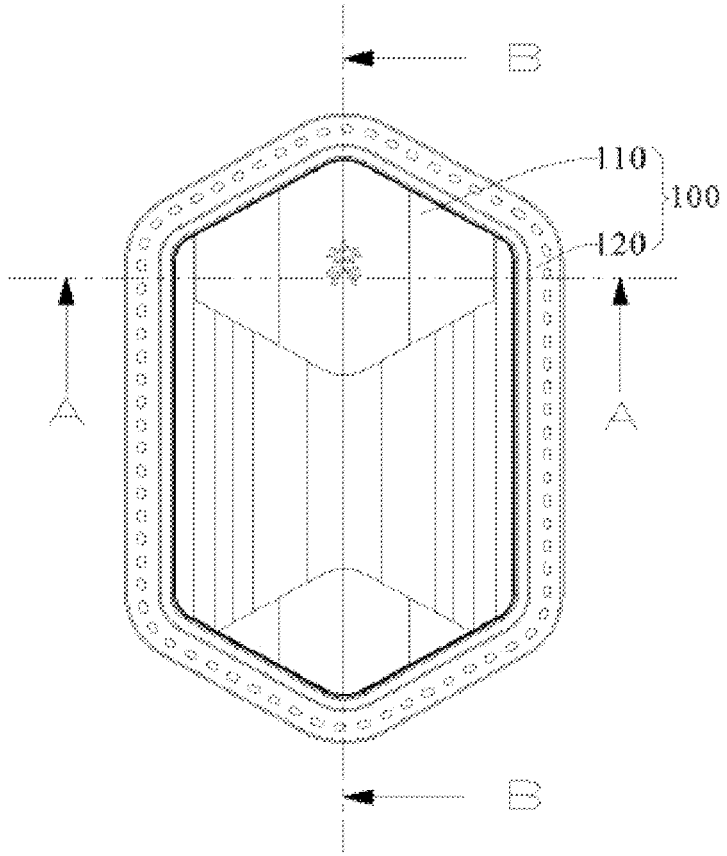
FIG. 5 is a front view of the suspension module with a shock absorbing effect according to the present application.
Figure 6:
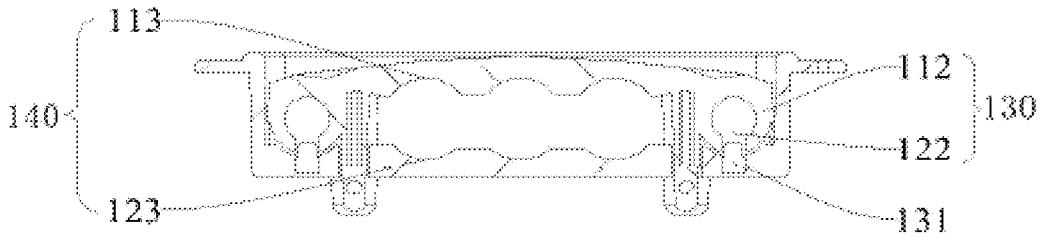
FIG. 6 is a sectional view of the housing along A-A direction shown in FIG. 5.
Figure 7:
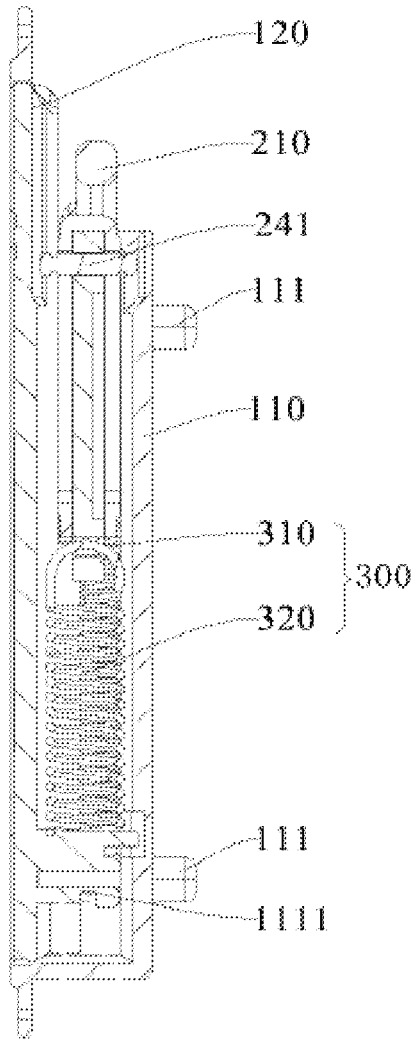
FIG. 7 is a sectional view of the suspension module with a shock absorbing effect along B-B direction shown in FIG. 5.

Specifically, as shown in FIG. 4, the pin 252 is provided at the upper end of the movable rod 250 to prevent the movable rod 250 from further moving upward when the movable rod 250 moves upward to the upper end of the movable slot 240, and to prevent the movable rod 250 from further moving downward when the movable rod 250 moves downward to the lower end of the movable slot 240. That is to say, the movable distance of the movable rod 250 is equal to the length of the movable slot 240. The lower end of the movable rod 250 defines a connecting hole 251 thereon, and the movable rod 250 is connected to the second elastic component 320 through the connecting hole 251. The first elastic component 310 and the second elastic component 320 together constitute the elastic component 300 of the suspension module, and the elastic component 300 is stretched as the puller 200 moves upward.

Figure 8:
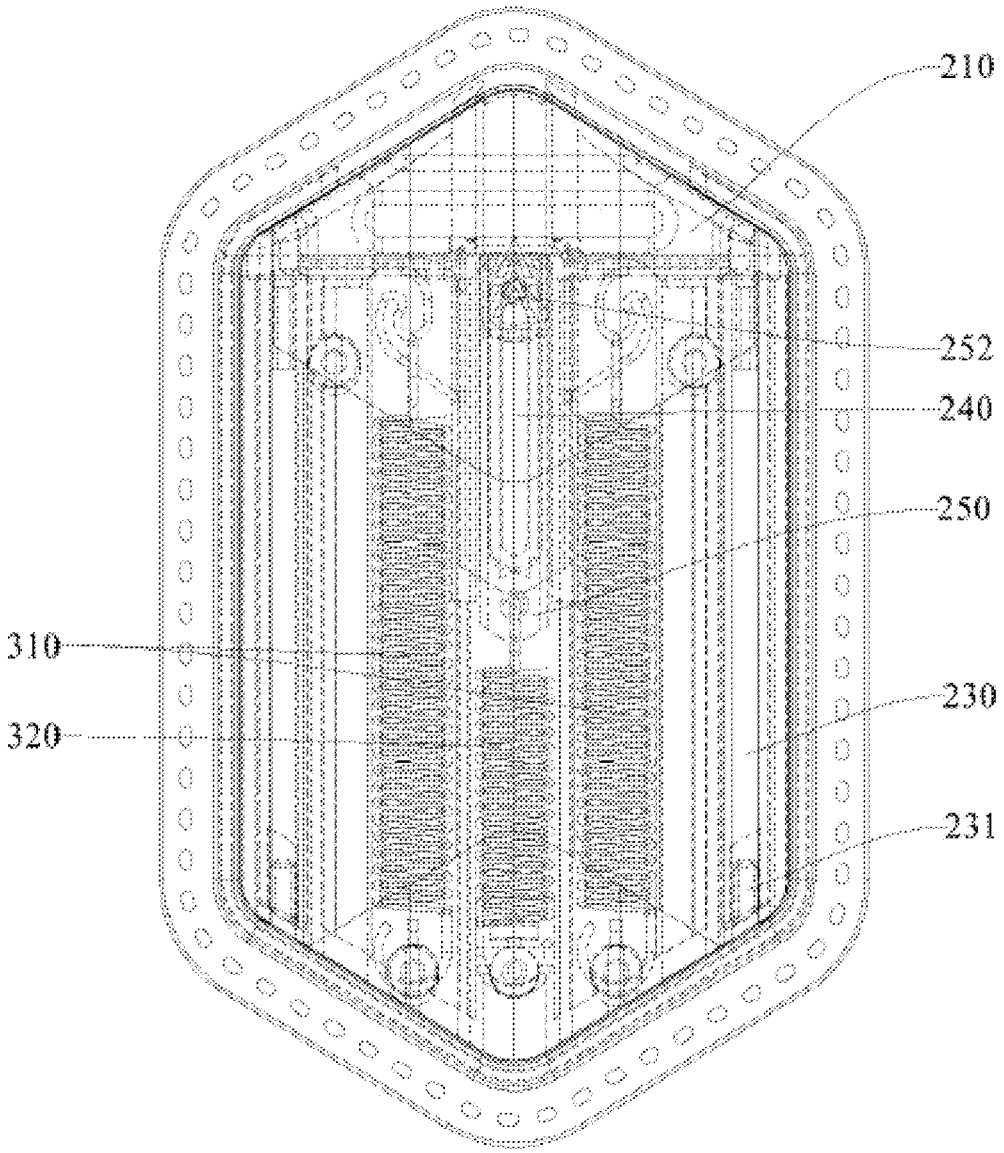
FIG. 8 is a schematic diagram showing the initial state of the suspension module with a shock absorbing effect according to the present application.
Figure 9:
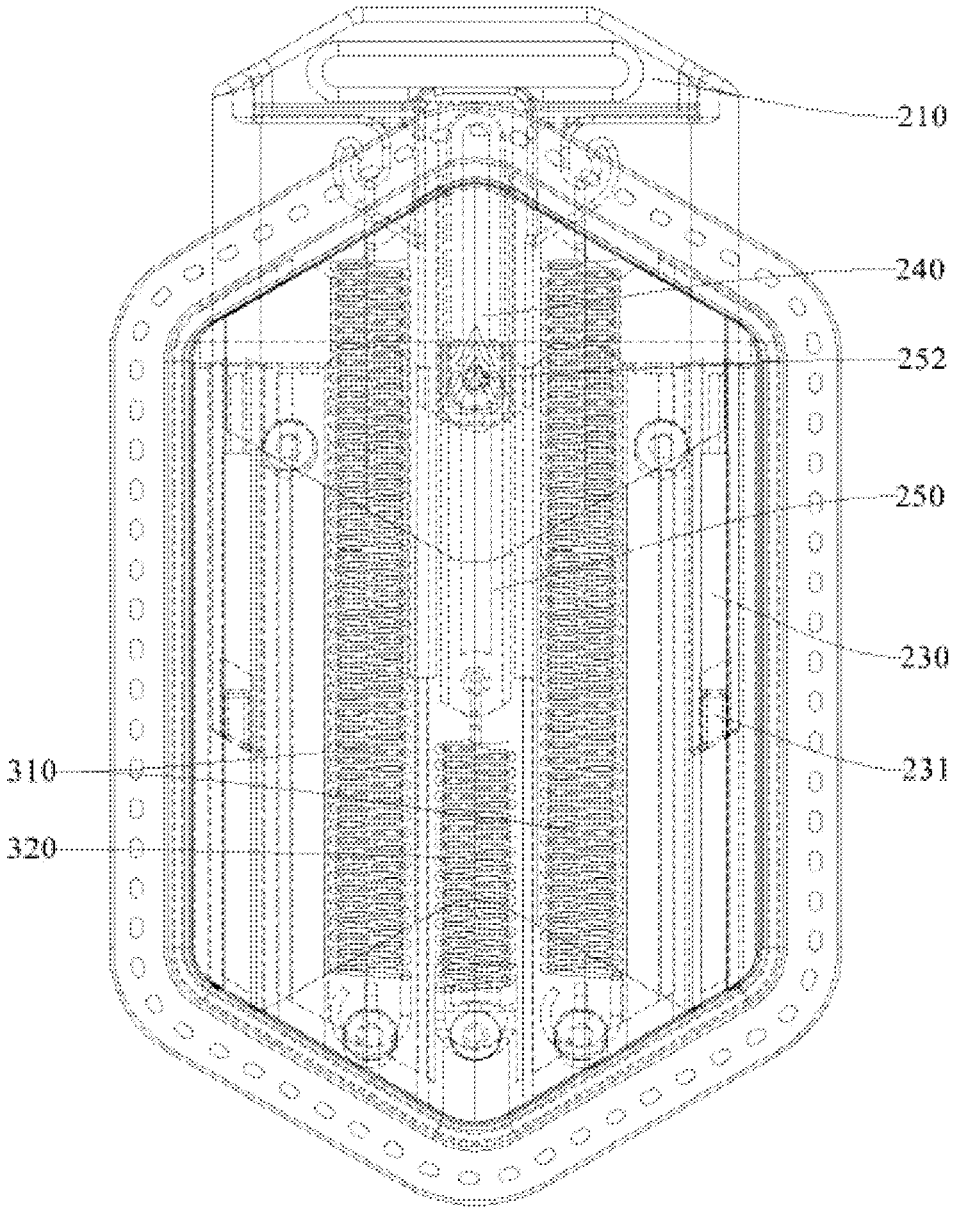
FIG. 9 is a schematic diagram showing the first stage stretching of the suspension module with a shock absorbing effect according to the present application.
Figure 10:
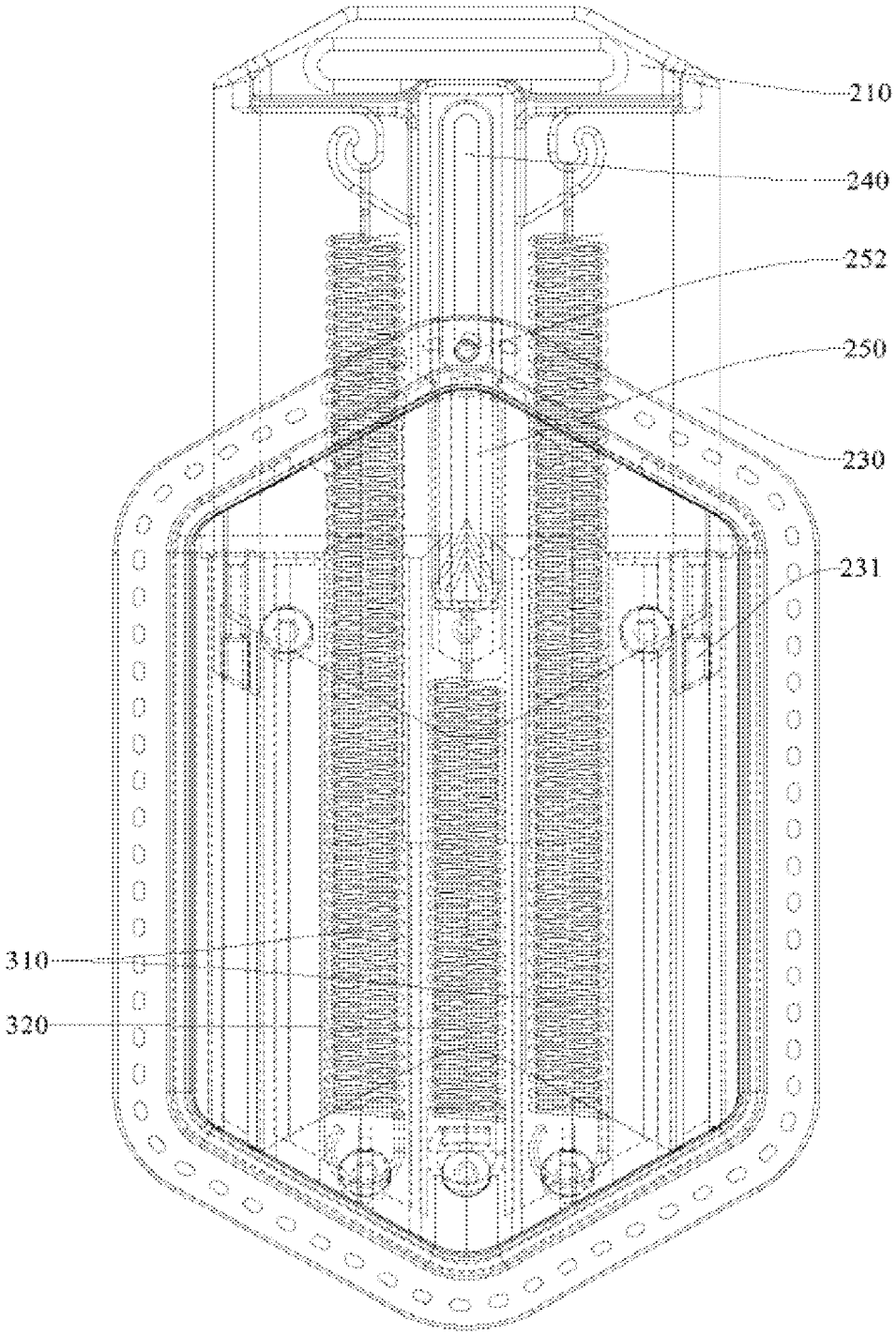
FIG. 10 is a schematic diagram showing the second stage stretching of the suspension module with a shock absorbing effect according to the present application.

Specifically, as shown in FIG. 8, when the puller 200 is not pulled, the elastic component 300 is in the initial state, that is, the first elastic component 310 and the second elastic component 320 are not stretched. In a first stage, the puller 200 is pulled upward, the first elastic component 310 is stretched, the movable slot 240 moves upward with the puller 200, and the pin 252 gradually moves away from the upper end of the movable slot 240 and continuously approaches the lower end of the movable slot 240. At this time, the movable rod 250 remains motionless relative to the backpack body, the second elastic component 320 is not stretched. The suspension module reaches an initial load threshold. When the puller 200 is pulled to a certain distance, the pin 252 of the movable rod 250 reaches the lower end of the movable slot 240, as shown in FIG. 9. At this time, the first elastic component 310 is stretched, and the second elastic component 320 is in the initial state, and the suspension module reaches a first load threshold. In a second stage, as shown in FIG. 10, the puller 200 continues to be pulled upward, the first elastic component 310 continues to be stretched, and the movable rod 250 is restricted by the pin 252 and moves upward with the puller 200. At this time, the second elastic component 320 is stretched. When the puller 200 can no longer be pulled, a second load threshold (i.e., maximum load threshold) of the suspension module is reached.

Taking a backpack as an example, the housing of the suspension module is fixedly connected to the body of the backpack, the puller of the suspension module is connected to the shoulder strap of the backpack, so that the suspension module reduces the impact force generated by the backpack during walking based on the shock absorbing effect of the elastic component, reduces the pressure of the backpack. The connection between the suspension module and the backpack adopts the existing technology.

Take the first load threshold of 6 kg and the second load threshold of 12 kg as an example.

In the prior art, a single group or multiple groups of elastic elements are used in the suspension module, and the one or more groups of elastic elements are connected in a same way. When the backpack weight is 10 kg or more, at least two groups of elastic elements are required for the suspension module if each group of elastic elements has a threshold range of 2-6 kg. In this case, the initial load threshold of the suspension module is at least 4 kg. This kind of suspension module is unsuitable for backpacks with a load of 2-4 kg. Although only one group of elastic elements is required for the suspension module if each group of elastic elements has a threshold range of 6-12 kg, the suspension module cannot provide shock absorbing effect when the backpack weight is less than 6 kg. In another aspect, if only one group of elastic elements with a threshold range of 2-12 kg is used, the initial length and stretching length of the elastic components will increase, the occupied space will be larger, and the amplitude of the elastic elements will increase, affecting the shock absorbing effect.

The suspension module according to the application only needs a first elastic component 310 with a threshold range of 2-6 kg and a second elastic component 320 with a threshold range of not less than 6 kg to achieve a shock absorbing effect within the threshold range of 2-12 kg. In a specific embodiment, when the backpack load reaches the initial load threshold, the first elastic component 310 works; when the backpack load reaches the second load threshold, the first elastic component 310 and the second elastic component 320 work simultaneously. In the case of achieving the same load threshold range, the suspension module according to the application requires less number of elastic components so that the weight of the suspension module itself is controlled, and requires a small stretching length, little space to be occupied, and has a wide scope of applications.

It can be understood that in other embodiments, elastic elements with different threshold ranges can be used for the first elastic component 310 and the second elastic component 320 according to actual needs to adapt to backpacks with greater load threshold requirements.

Further, the elastic component 300 includes but is not limited to a tension spring, a compression spring, or a combination of a tension spring and a compression spring.

It can be understood that in different embodiments, the first elastic component 310 and the second elastic component 320 can be combined with springs of different spring constants to allow a smaller initial load threshold or a larger maximum load threshold. Meanwhile, in the present embodiment, the first elastic component 310 includes two tension springs with the same spring constant, and the second elastic component 320 includes one tension spring, and the spring constants of the first elastic component 310 and the second elastic component 320 are not necessarily the same.

Further, the housing 100 includes a front housing 110 and a rear housing 120. The rear housing 120 defines a plurality of positioning holes 121 thereon, and the inner side of the front housing 110 is provided with a plurality of positioning pins 111, and the front housing 110 is fixedly connected to the rear housing 120 by inserting the positioning pins 111 into the positioning holes 121. The front housing 110 and the rear housing 120 are combined to form a housing 100 with an opening at the upper end, and an installation cavity is formed between the front housing 110 and the rear housing 120, and the puller 200 is arranged in the installation cavity through the opening.

Further, a concave hanging groove 1111 is defined on some of the positioning pins 111, and the hanging groove 1111 is used to fix the lower ends of the first elastic component 310 and the second elastic component 320. It can be understood that the first elastic component 310 connected to the hook 220 and the hanging groove 1111 and the second elastic component 320 connected to the movable rod 250 and the hanging groove 1111 are in the same plane and parallel to each other. Moreover, the first elastic component 310 and the second elastic component 320 are also parallel to the guide posts 230.

Further, as shown in the figure, the puller 200 is has an axisymmetric structure, and a connecting part 210 provided at the upper end of the puller 200. A cavity is defined at the middle position of the lower end of the connecting part 210, and a movable rod 250 is provided in the cavity. Opposing movable slots 240 are provided at the front and rear sides of the cavity. There is one connecting hole 251 defined at each of the upper and lower ends of the movable rod 250. The connecting hole 251 at the upper end is provided with a pin 252 that extends through the movable slot 240 to limit the movement of the movable rod 250 in the movable slot 240. The connecting hole 251 at the lower end is used to connect with the second elastic component 320. A hook 220 is provided at the lower end of the connecting part 210 on the left and right sides of the cavity respectively. The hooks 220 are used to connect with the upper end of the first elastic component 310. A guide post 230 is also provided on both sides of the connecting part 210, and the puller 200 is slidably connected to the guide recesses 130 of the housing 100 via the guide posts 230.

Preferably, in this embodiment, the connecting part 210, the hooks 220, the cavity and the guide posts 230 are integrally formed. It can be understood that in some embodiments, the hook 220, the cavity and the guide posts 230 may be fixedly connected to the connecting part 210 through a connector.

Furthermore, the housing 100 also includes a limiting groove that includes a first limiting groove 114 provided on the front housing 110 and a second limiting groove 124 provided on the rear housing 120. The positions of the first limiting groove 114 and the second limiting groove 124 correspond to the upper end of the movable slot 240. When the pin 252 is at the uppermost end of the movable slot 240, the suspension module is in an initial state, and the first elastic component 310 and the second elastic component 320 are in an original state that is neither stretched nor compressed. Both ends of the pin 252 are suspended at the first limiting groove 114 and the second limiting groove 124, so that the movable rod 250 does not fall naturally under the influence of gravity, causing the compression of the second elastic component 320.

Further, the guide posts 230 are located at the lower end of the connecting part 210. A limiting block 231 is provided at the end of each guide post 230 away from the connecting part 210. A limit surface 131 is provided at the upper side of each guide recess 130. When the limiting block 231 moves to the upper part of the guide recess 130, it is blocked by the limit surface 131 to prevent the puller 200 from being pulled away from the housing 100.

As shown in FIG. 10, when the puller is stretched to a certain distance, the limiting block 231 is blocked by the limit surface 131, and the puller 200 cannot continue to move upward. At this time, the second elastic component 320 reaches the longest state, and the suspension module reaches the maximum load threshold, that is, the second load threshold.

Further, each of the guide recesses 130 includes a slide slot 122 defined on the inner side of the rear housing 120 and an arc slot 112 defined on the inner side of the front housing 110. The slide slot 122 is slidably connected to the guide post 230, and the arc slot 112 is provided outside the guide post 230, so that the guide post 230 moves along a fixed direction. A limit surface 131 is provided at the upper end of the slide slot 122. When the guide post 230 moves along the slide slot 122 to the limit surface 131, it cannot move further. At this time, the second elastic component 320 is stretched to the longest state, reaching the first load threshold of the suspension module. The guide recess 130 can not only limit the moving direction of the guide post 230, but also balance the puller 200 left and right during the pulling process, avoid the lateral shaking of the elastic component 300, reduce the friction between the elastic component 300 and the housing 100, and avoid causing noise.

Further, the bottom surface of the lower end of the arc slot 112 can limit the downward movement of the guide post 230.

Further, in some embodiments, the suspension module may include one or more guide recesses, and one or more guide posts corresponding to the one or more guide recesses. The application of multiple guide recesses and guide posts can make the structure of the suspension module more stable, and the elastic component 300 will not deviate in the lateral direction, so that the elastic components are prevented from causing friction and noise.

Further, an avoidance groove 140 is defined on the housing 100. The avoidance groove 140 is formed by the first groove 113 on the front housing 110 and the second groove 123 on the rear housing 120. The space defined by the avoidance groove 140 is used to place the first elastic component 310 and the second elastic component 320. The avoidance groove 140 further reduces the friction between the elastic component 300 and the housing 100 when the elastic component 300 is stretched, thereby avoiding the generation of noise and providing the user with a better user experience.

Further, in some embodiments, a weight mark is provided on the left and right sides of the front housing 110, and the mark is used to display the weight value in real time. The mark indicates the weight value of the suspension module when the guide post 230 is in different positions, and the user can obtain the weight information in real time according to the position of the corresponding mark of the limiting block 231 at the lower end of the guide post 230.

Figure 11:
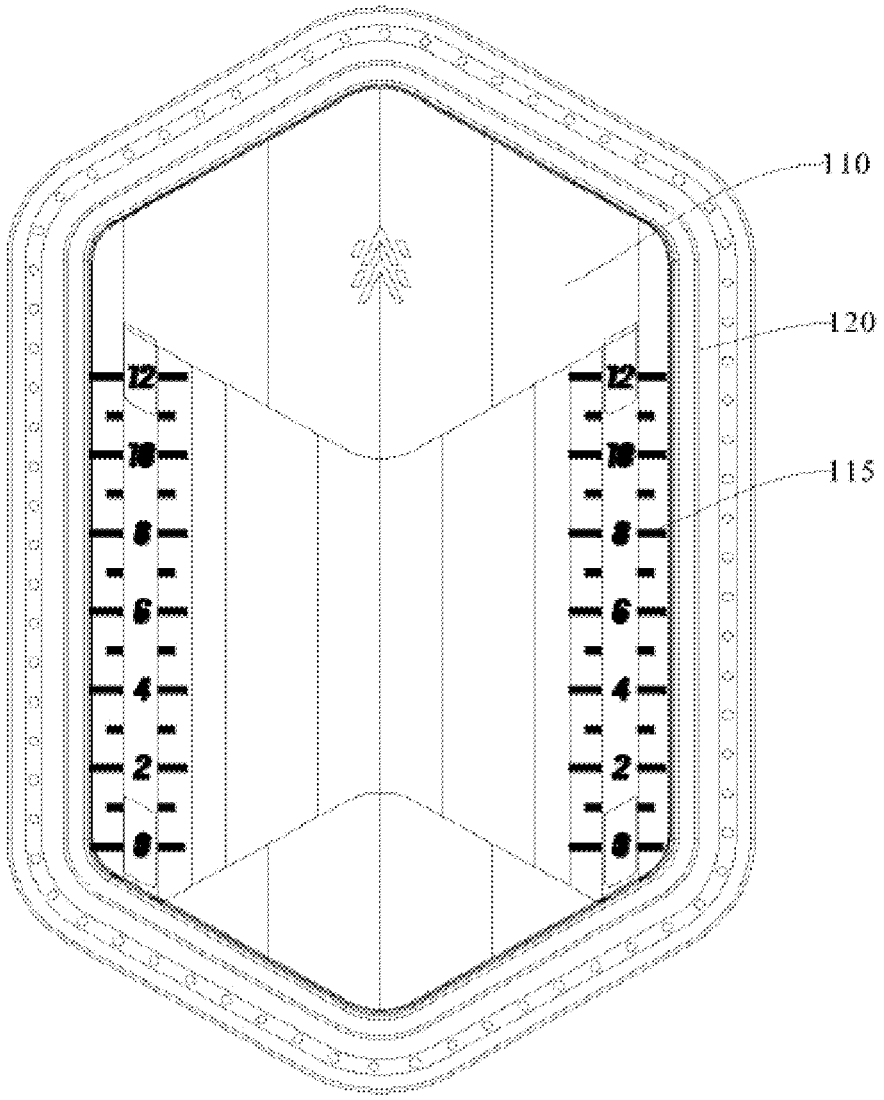
FIG. 11 is a schematic diagram showing the mark on the suspension module with a shock absorbing effect shown in FIG. 5.

Specifically, as shown in FIG. 11, a floating buoy is provided at the bottom of the guide post 230, and the part of the front housing 110 facing the buoy is the weight value of the mark 115, and the left and right sides of the weight value are weight scale indications. The buoy and the guide post 230 move synchronously. When the guide post 230 moves upward, the buoy also moves upward, correspondingly displaying different weight values, that is, the weight condition of the backpack. Preferably, the buoy can be made of fluorescent material so that the user can observe the weight condition of the backpack even in a dark environment.

Further, the number of the marks 115 includes but is not limited to one group. Specifically, the number of the marks 115 may be the same as the number of the guide posts 230, or may be less than the number of the guide posts 230.

Further, in some embodiments, the front housing 110 is partially transparent or fully transparent, which is convenient for displaying the real-time position of the buoy.

Further, in some embodiments, the rear housing 120 also includes stitching holes 125 defined on the skirt of the rear housing 120, and the skirt has a certain height difference from the upper edge of the rear housing 120, so that the suspension module can be embedded and connected to the backpack body.

Further, in some embodiments, the front housing 110 is made of hard plastic, and the rear housing 120 is made of soft plastic. In this embodiment, the opening of the arc slot 112 of the front housing 110 can only accommodate the width of the limiting block 231, and the puller 200 is arranged in the arc slot 112. The puller 200 can be pulled up and down in the arc slot 112, and does not need to be stressed by the slide slot 122 of the rear housing 120. Therefore, the use of soft plastic for the rear housing 120 does not affect the overall stretching of the puller 200. Moreover, the combination of hard plastic and soft plastic makes it convenient to sew the rear housing skirt to the package body while ensuring the overall strength of the suspension module, and there is no need to forming stitching holes. The outer surface of the housing and the surface of the package body are flat and have no protrusions, which makes the user experience better.

The suspension module with a shock absorbing effect according to the application can provide a shock absorbing effect under different load conditions based on the combination of the first elastic component 310 and the second elastic component. As a result, the load threshold range is large, the space occupied is small, and the application range is wide.

The application also provides a backpack, including the suspension module with a shock absorbing effect disclosed in the embodiments of the present application.

The application also provides a shoulder bag, including the suspension module with a shock absorbing effect disclosed in the embodiments of the present application.

The application also provides a suitcase, including the suspension module with a shock absorbing effect disclosed in the embodiments of the present application.

The above embodiments are only for illustrating the technical concept and features of the application, which aims to enable people familiar with this technology to understand the content of the application and implement it accordingly, and cannot limit the protection scope of the application. All equivalent changes and modifications made to the scope of the claims of the present application shall fall within the scope of the claims of the present application.

It should be understood that those skilled in the art can make improvements or changes based on the above description, and all such improvements and changes shall fall within the scope of protection of the claims attached to the present application.

What is claimed is:

1. A suspension module with a shock absorbing effect, comprising:

a housing, having an opening at an upper side thereof and defining one or more guide recesses;

a puller, extending through the opening and slidably connected to the one or more guide recesses, wherein the puller defines a cavity, in which a movable rod is provided, one end of the movable rod extends through the cavity and is movable up and down, and a pin is provided on the movable rod to limit a movable distance of the movable rod;

a first elastic component, having an upper end connected to the puller and a lower end connected to the housing; and a second elastic component, having an upper end connected to the movable rod and a lower end connected to the housing.

2. The suspension module with the shock absorbing effect according to claim 1, wherein the first elastic component and the second elastic component are tension springs, and the first elastic component comprises two of the tension springs, and the second elastic component comprises one of the tension springs.

3. The suspension module with the shock absorbing effect according to claim 1, wherein the housing comprises a front housing and a rear housing;

wherein the rear housing defines a plurality of positioning holes;

a plurality of positioning pins are provided on an inner side of the front housing, and are configured to be plugged into the positioning holes.

4. The suspension module with the shock absorbing effect according to claim 3, wherein the puller comprises a connecting part, a hook and guide posts;

wherein the hook is arranged below the connecting part, and the hook is configured to connect with the upper end of the first elastic component;

the guide posts are arranged on both sides of the connecting part, and the guide posts are connected to the one or more guide recesses; and the connecting part, the hook and the guide posts are integrally formed.

5. The suspension module with the shock absorbing effect according to claim 4, wherein a limiting block is provided at an end of each of the guide posts away from the connecting part, and a limit surface is provided at an upper side of each of the one or more guide recesses to stop the limiting block of the guide post connected to the guide recess when the limiting block moves to the upper side of the guide recess.

6. The suspension module with the shock absorbing effect according to claim 4, wherein each of the one or more guide recesses comprises a slide slot and an arc slot;

wherein the slide slot is arranged on an inner side of the rear housing and is slidably connected to a corresponding one of the guide posts;

the arc slot is arranged on the inner side of the front housing and is arranged outside the guide post, so that the guide post is movable along a fixed direction.

7. The suspension module with the shock absorbing effect according to claim 3, wherein at least one of the plurality of positioning pins defines a hanging groove configured to fix the lower ends of the first elastic component and of the second elastic component.

8. The suspension module with the shock absorbing effect according to claim 3, wherein the housing defines an avoidance groove to reduce friction and noise generated when the first elastic component and the second elastic component are stretched.

9. The suspension module with the shock absorbing effect according to claim 3, wherein the front housing is provided with a mark to show a value of load weight of the suspension module in real time.

10. The suspension module with the shock absorbing effect according to claim 3, wherein the front housing is partially or fully transparent for displaying a real-time position of the guide posts.

11. The suspension module with the shock absorbing effect according to claim 3, further comprising stitching holes provided around the rear housing, so that the suspension module with a shock absorbing effect is embedded and connected to a backpack body.

12. The suspension module with the shock absorbing effect according to claim 3, wherein the front housing is made of hard plastic, and the rear housing is made of soft plastic.

13. A backpack, comprising a suspension module with a shock absorbing effect, wherein the suspension module comprises:

a housing, having an opening at an upper side thereof and defining one or more guide recesses;

a puller, extending through the opening and slidably connected to the one or more guide recesses, wherein the puller defines a cavity, in which a movable rod is provided, one end of the movable rod extends through the cavity and is movable up and down, and a pin is provided on the movable rod to limit a movable distance of the movable rod;

a first elastic component, having an upper end connected to the puller and a lower end connected to the housing; and a second elastic component, having an upper end connected to the movable rod and a lower end connected to the housing.

14. The backpack according to claim 13, wherein the first elastic component and the second elastic component are tension springs, and the first elastic component comprises two of the tension springs, and the second elastic component comprises one of the tension springs.

15. The backpack according to claim 13, wherein the housing comprises a front housing and a rear housing;

wherein the rear housing defines a plurality of positioning holes;

a plurality of positioning pins are provided on an inner side of the front housing, and are configured to be plugged into the positioning holes.

16. The backpack according to claim 15, wherein the puller comprises a connecting part, a hook and guide posts;

wherein the hook is arranged below the connecting part, and the hook is configured to connect with the upper end of the first elastic component;

the guide posts are arranged on both sides of the connecting part, and the guide posts are connected to the one or more guide recesses; and the connecting part, the hook and the guide posts are integrally formed.

17. The backpack according to claim 16, wherein a limiting block is provided at an end of each of the guide posts away from the connecting part, and a limit surface is provided at an upper side of each of the one or more guide recesses to stop the limiting block of the guide post connected to the guide recess when the limiting block moves to the upper side of the guide recess.

18. The backpack according to claim 16, wherein each of the one or more guide recesses comprises a slide slot and an arc slot;

wherein the slide slot is arranged on an inner side of the rear housing and is slidably connected to a corresponding one of the guide posts;

the arc slot is arranged on the inner side of the front housing and is arranged outside the guide post, so that the guide post is movable along a fixed direction.

19. The backpack according to claim 15, wherein at least one of the plurality of positioning pins defines a hanging groove configured to fix the lower ends of the first elastic component and of the second elastic component.

20. The backpack according to claim 15, wherein the housing defines an avoidance groove to reduce friction and noise generated when the first elastic component and the second elastic component are stretched.

* * * * *